US010625403B2

(12) United States Patent
Hsieh

(10) Patent No.: US 10,625,403 B2
(45) Date of Patent: Apr. 21, 2020

(54) INERTIAL ROTATIONAL TIGHTENING DEVICE

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 170 days.

(21) Appl. No.: 16/007,412

(22) Filed: Jun. 13, 2018

(65) Prior Publication Data

US 2019/0105761 A1 Apr. 11, 2019

(30) Foreign Application Priority Data

Oct. 5, 2017 (TW) ..... 106134414 A

(51) Int. Cl.

| | |
|---|---|
| ***B25B 21/00*** | (2006.01) |
| ***B25B 23/00*** | (2006.01) |
| ***B25B 21/02*** | (2006.01) |
| ***B25B 13/06*** | (2006.01) |
| ***B25B 23/14*** | (2006.01) |
| *B25B 23/145* | (2006.01) |

(52) U.S. Cl.

CPC ..... *B25B 21/004* (2013.01); *B25B 13/06* (2013.01); *B25B 21/026* (2013.01); *B25B 23/0035* (2013.01); *B25B 23/1405* (2013.01); *B25B 21/02* (2013.01); *B25B 23/1453* (2013.01)

(58) Field of Classification Search

CPC ..... B25B 21/004; B25B 21/026; B25B 21/02; B25B 23/0035; B25B 23/1405; B25B 23/1453; B25B 13/06

See application file for complete search history.

(56) References Cited

U.S. PATENT DOCUMENTS

| | | | | |
|---|---|---|---|---|
| 9,566,692 | B2 * | 2/2017 | Seith | B25B 13/06 |
| 10,315,294 | B2 * | 6/2019 | Rettler | B25B 23/1475 |
| 10,391,615 | B2 * | 8/2019 | Hsieh | B25B 13/06 |
| 10,427,277 | B2 * | 10/2019 | McClung | B25B 21/02 |
| 10,442,061 | B2 * | 10/2019 | Hsieh | B25B 23/1475 |
| 2012/0255749 | A1 * | 10/2012 | Seith | B25B 13/06 173/1 |

(Continued)

*Primary Examiner* — David B. Thomas
(74) *Attorney, Agent, or Firm* — Guice Patents PLLC

(57) ABSTRACT

An inertial rotational tightening device includes: a rotationally drivable main body, an annular engagement section being disposed on a circumference of the main body; an inertial member having an engagement hole axially formed through the inertial member, the engagement hole of the inertial member being detachably engaged with the engagement section of the main body, a retaining groove being formed on a circumference of the engagement section or a hole wall of the engagement hole, an insertion groove being formed on the hole wall of the engagement hole or the circumference of the engagement section; and an elastic retainer member inlaid and buckled in the retaining groove and the insertion groove. The inertial member is detachably connected with the main body. Different inertial members with different mass can be selectively mounted on the main body to change the moment of inertia and the rotational torque of the rotational tightening device.

14 Claims, 8 Drawing Sheets

(56) References Cited

U.S. PATENT DOCUMENTS

| | | | | |
|---|---|---|---|---|
| 2015/0217433 | A1* | 8/2015 | Seith | B25B 23/0035 81/124.6 |
| 2017/0113334 | A1* | 4/2017 | Seith | B25B 13/06 |
| 2018/0311800 | A1* | 11/2018 | Chu | B25B 21/02 |
| 2019/0126447 | A1* | 5/2019 | Chu | B25B 23/12 |

* cited by examiner

INERTIAL ROTATIONAL TIGHTENING DEVICE

BACKGROUND OF THE INVENTION

1. Field of the Invention

The present invention relates generally to a device for rotationally tightening or untightening a fastening member, and more particularly to a rotational tightening device with rotational inertia.

2. Description of the Related Art

It is known that a fastening member such as a bolt, a nut or the like threaded member is used to connect articles. The fastening members are widely used in various fields. In order to enhance the operation efficiency, a power tool (such as a pneumatic wrench) is often used in cooperation with a rotary device such as a commonly seen socket to rotationally drive the threaded member. In order to enhance the ability of the power tool and the socket to tighten or untighten the threaded member, an inertial member with larger outer diameter is conventionally fitted on the outer circumference of the socket. For example, US patent publication No. US2012/0255749A1 "rotary impact device" discloses an inertial member fitted on the socket. By means of the moment of inertia of the inertial member, the rotational torque of the socket is enhanced so as to enhance the action force of the power tool and the socket for rotationally driving the threaded member.

In the above US patent, the inertial member is integrally disposed on the socket. Such design can truly enhance the rotational torque of the power tool for rotationally driving the threaded member. However, after used, it is found that such design still has some shortcomings. This is because the sizes of the threaded members used in different sites and different articles are not identical. The conventional inertial member is integrally disposed on the socket so that it is impossible to replace the inertial member. That is, the integrated inertial member can only provide constant moment of inertia and rotational torque for the socket and the inertial member cannot be applied to various sizes of threaded members. In the case that the inertial member is applied to a threaded member with a smaller size, the rotational torque of the inertial member will be too great for the small-size threaded member so that the threaded member will be over-tightened. This may cause damage of the threaded member. Reversely, in the case that the inertial member is applied to a threaded member with a larger size, the rotational torque of the inertial member will be insufficient to truly tighten the threaded member.

SUMMARY OF THE INVENTION

It is therefore a primary object of the present invention to provide a rotational tightening device with rotational inertia. The rotational tightening device is such designed that the moment of inertia of the rotational tightening device is changeable.

It is a further object of the present invention to provide the above inertial rotational tightening device, in which the inertial member is replaceable.

To achieve the above and other objects, the inertial rotational tightening device of the present invention includes:

a main body having an axis, the main body being rotatable around the axis as a center, the main body further having a linking end and a drive end respectively disposed at two ends of the main body, the linking end being for connecting with a power tool, the drive end being for rotationally driving a fastening member, an annular engagement section being disposed on a circumference of the main body;

an inertial member having an engagement hole axially formed through the inertial member, the engagement hole of the inertial member being detachably engaged with the engagement section of the main body, an annular retaining groove being formed on a circumference of the engagement section or a hole wall of the engagement hole, the retaining groove having a configuration with a wider opening and a narrower interior, an insertion groove being formed on the hole wall of the engagement hole or the circumference of the engagement section; and an elastic retainer member having the form of a ring, the rims of the elastic retainer member being inlaid and buckled in the retaining groove and the insertion groove.

According to the above arrangement, the inertial member is detachably connected with the main body. Different inertial members with different mass can be selectively mounted on the main body to change the moment of inertia and the rotational torque of the rotational tightening device.

The retaining groove has a rear groove wall proximal to the linking end and a front groove wall proximal to the drive end. Preferably, the front groove wall has a resistance greater than a resistance of the rear groove wall, whereby it is uneasy for the retainer member to detach out of the retaining groove from the front groove wall so that the inertial member can be effectively retained on the main body.

Preferably, the engagement section has multiple first engagement teeth engaged with multiple second engagement teeth of the engagement hole. The tooth flanks of the adjacent first and second engagement teeth are in point-contact with each other, not in face-contact with each other.

The present invention can be best understood through the following description and accompanying drawings, wherein:

DETAILED DESCRIPTION OF THE PREFERRED EMBODIMENTS

Figure 1:
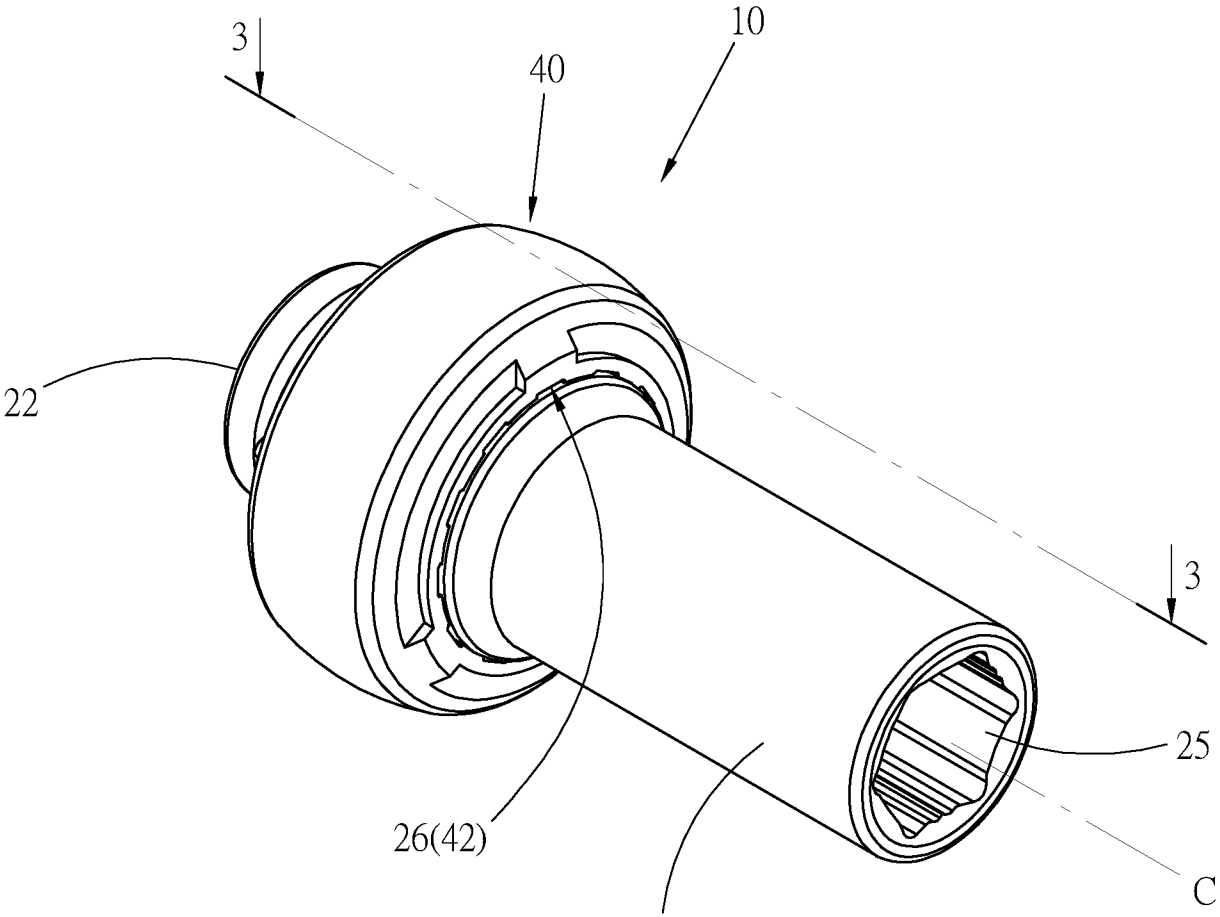
FIG. 1 is a perspective assembled view of a preferred embodiment of the rotational tightening device of the present invention.
Figure 2:
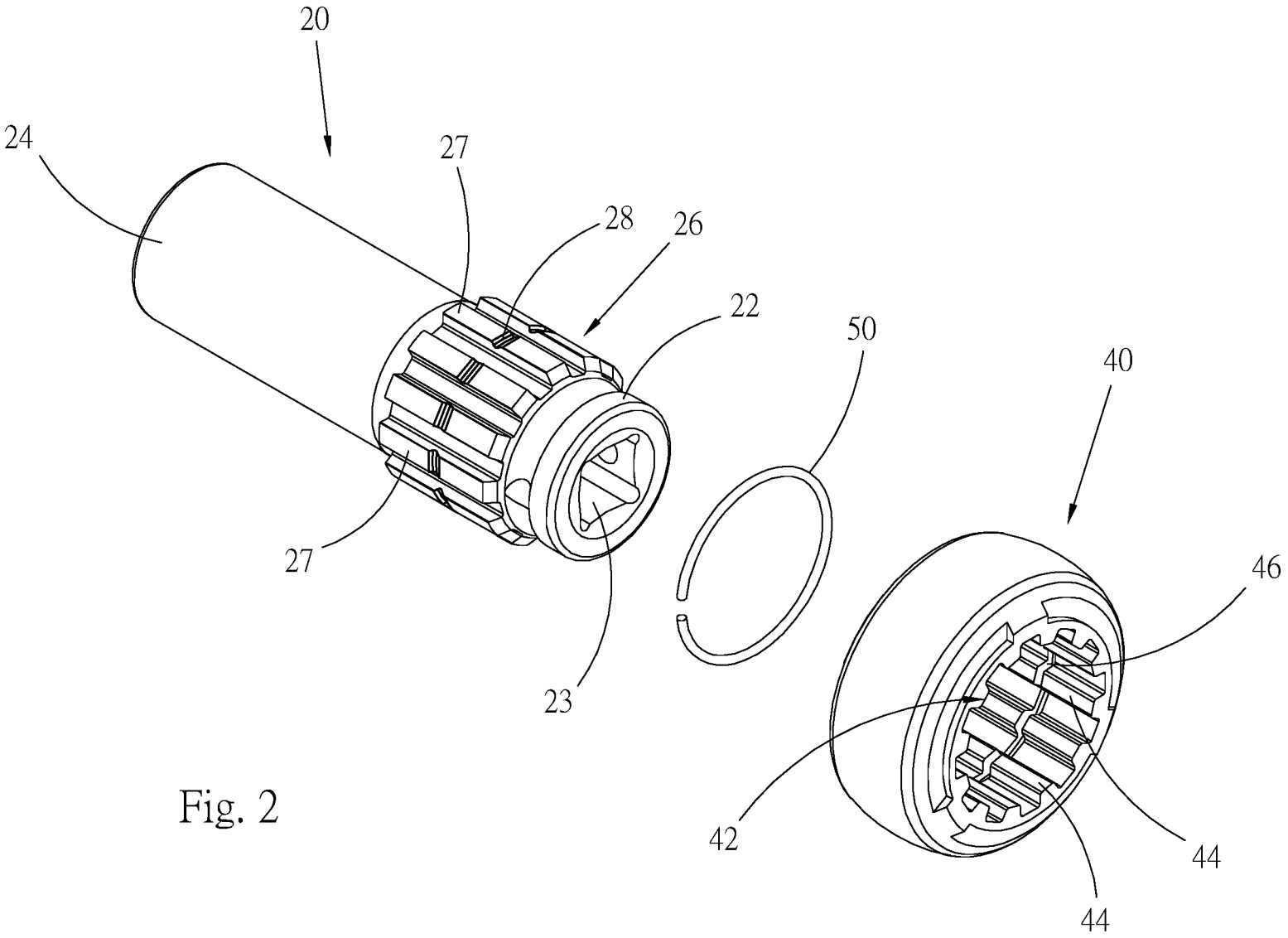
FIG. 2 is a perspective exploded view of the preferred embodiment of the rotational tightening device of the present invention according to FIG. 1.
Figure 3:
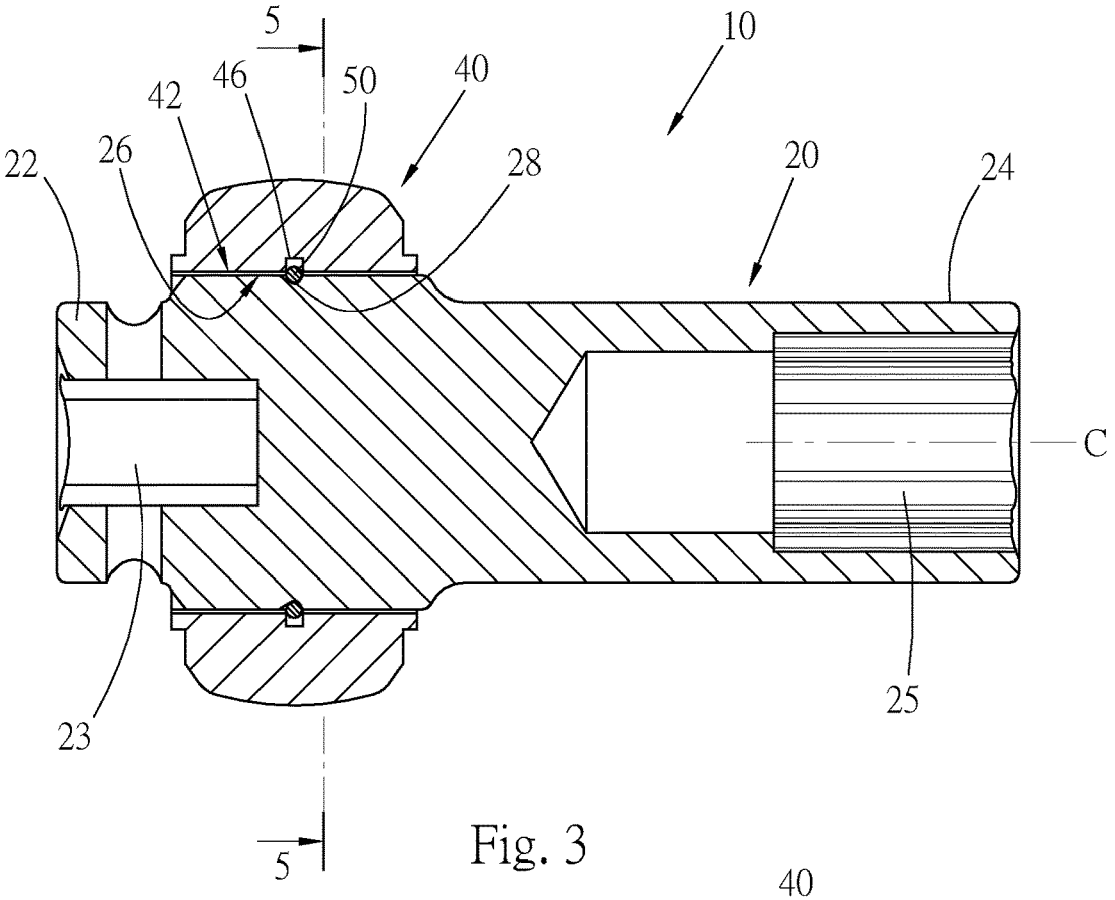
FIG. 3 is a sectional view taken along line 3-3 of FIG. 1.

Please refer to FIGS. 1 and 2. According to a preferred embodiment, the inertial rotational tightening device 10 of the present invention is used to rotationally drive a tightening member (such as a threaded member). The inertial rotational tightening device 10 includes a main body 20, an inertial member 40 and an elastic retainer member 50.

The main body 20 has a central axis C. When rotationally driven, the main body 20 is rotated around the central axis C. The main body 20 has a symmetrical configuration centered at the central axis C as a reference. A linking end 22 and a drive end 24 are respectively disposed at two ends of the main body 20. The linking end 22 is formed with a polygonal (such as quadrangular) connection hole 23 for connecting with a transmission shaft of a pneumatic tool. A polygonal (such as hexagonal or dodecagonal) socket 25 is formed at the drive end 24 for fitting with a threaded member.

Figure 4:
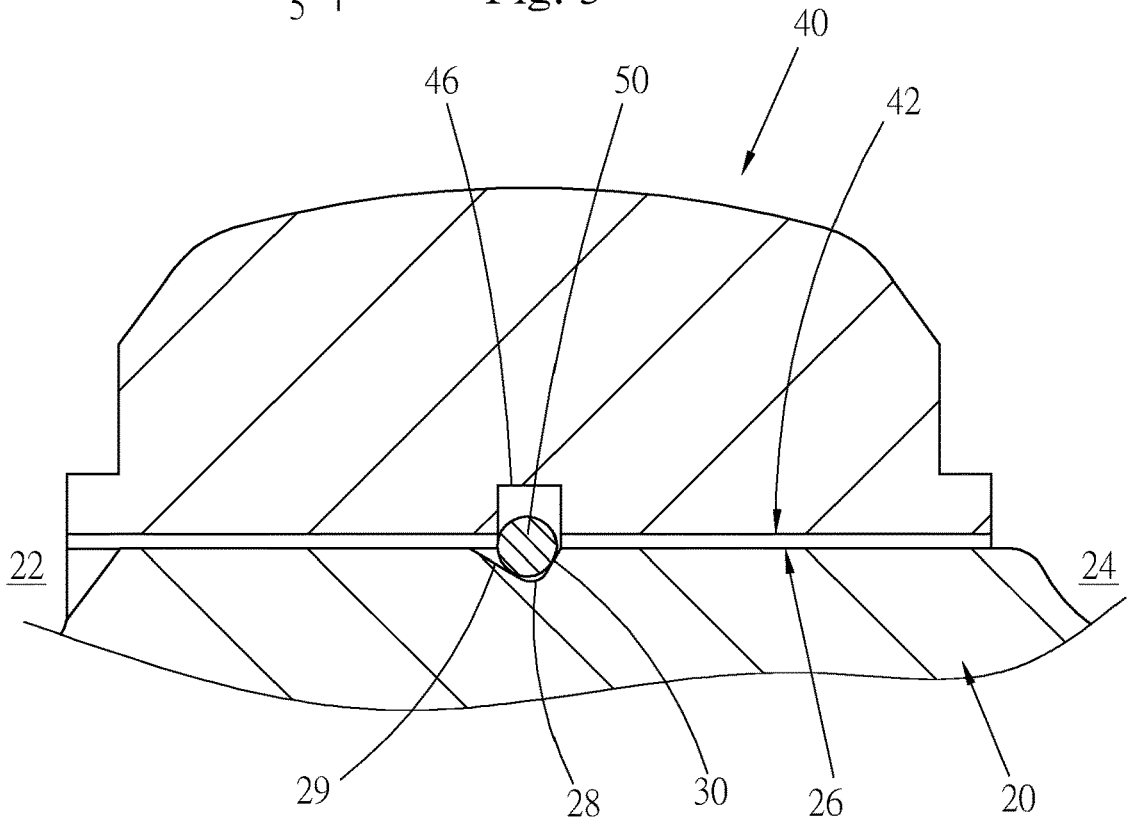
FIG. 4 is an enlarged view of a part of FIG. 3.

An annular engagement section 26 is disposed on a circumference of the main body 20. In this embodiment, the engagement section 26 has multiple first engagement teeth 27 annularly arranged on the circumference of the main body 20 at equal intervals. An annular retaining groove 28 is formed on the engagement section 26 to intersect the first engagement teeth 27. Please refer to FIG. 4, which is a sectional view of the retaining groove 28. The retaining groove 28 has a configuration with a wider opening and a narrower interior to form two inclined groove walls, that is, a rear groove wall 29 proximal to the linking end 22 and a front groove wall 30 proximal to the drive end 24. The slope of the front groove wall 30 is larger than the slope of the rear groove wall 29, that is, the inclination of the rear groove wall 29 is relatively gentle, while the front groove wall 30 is relatively steep.

Figure 5:
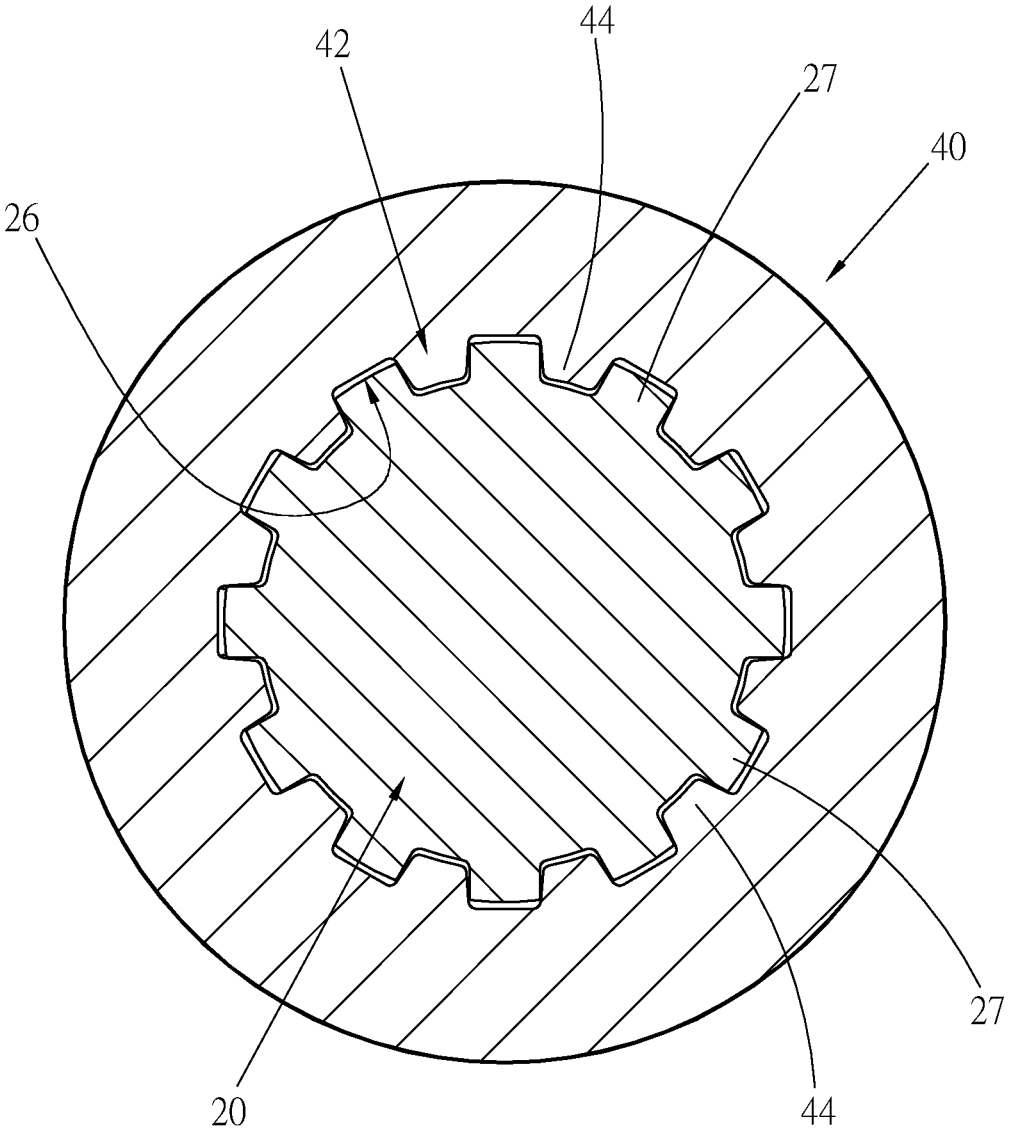
FIG. 5 is a sectional view taken along line 5-5 of FIG. 3.

The inertial member 40 is a ring body with such as a disc-shaped or cylindrical configuration. The mass center of the inertial member 40 is positioned at the center of the inertial member 40. The inertial member 40 has a mass symmetrical configuration and is not limited to the disc-shaped or cylindrical configuration as shown in the drawing. The outer diameter of the inertial member 40 is larger than the outer diameter of the main body 20. An engagement hole 42 is axially formed through the inertial member 40. Multiple second engagement teeth 44 are arranged on the circumferential wall of the engagement hole 42 at equal intervals. An annular insertion groove 46 is formed on the hole wall of the engagement hole 42 to intersect the engagement teeth 44. The engagement hole 42 of the inertial member 40 is engaged with the engagement section 26 of the main body 20. The first engagement teeth 27 are detachably engaged with the second engagement teeth 44, whereby the inertial member 40 can be separated from the main body 20 as shown in FIG. 5.

Figure 6:
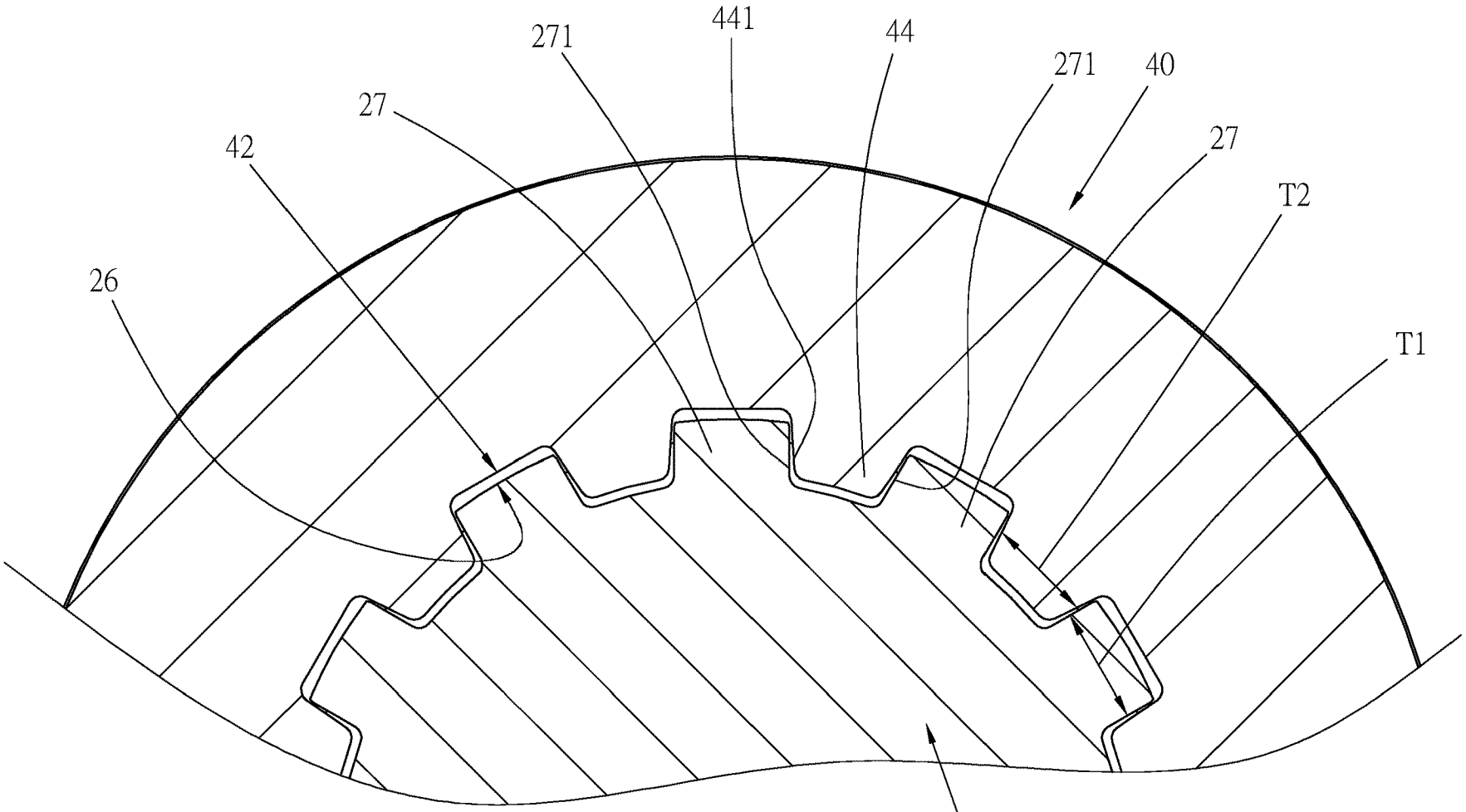
FIG. 6 is an enlarged view of a part of FIG. 5.

Also, please refer to FIG. 6. The first engagement teeth 27 and the second engagement teeth 44 preferably have the same tooth profile. In this embodiment, the first engagement teeth 27 and the second engagement teeth 44 are quadrangular teeth and the thickness T1 of the first engagement teeth 27 is different from the thickness T2 of the second engagement teeth 44. Alternatively, the slope of the tooth flank 271 of the first engagement teeth 27 is different from the slope of the tooth flank 441 of the second engagement teeth 44. Accordingly, when the first engagement teeth 27 and the second engagement teeth 44 are engaged with each other, the tooth flanks 271, 441 of the adjacent first and second engagement teeth 27, 44 are in point-contact with each other, not in face-contact with each other.

The elastic retainer member 50 has the form of a ring. In this embodiment, the elastic retainer member 50 is a C-shaped retainer, which can be elastically opened and closed. The elastic retainer member 50 is inlaid in the insertion groove 46. In normal state, when the inertial member 40 is engaged with the main body 20, the outer rim of the elastic retainer member 50 is inlaid in the insertion groove 46, while the inner rim of the elastic retainer member 50 is inlaid in the retaining groove 28. That is, the elastic retainer member 50 is connected with both the insertion groove 46 and the retaining groove 28.

The inertial member 40 can be fitted with the main body 20 from any end thereof so as to make the engagement hole 42 and the engagement section 26 engaged with each other. When fitted, the retainer member 50 is elastically expanded and moved into the insertion groove 46 of the inertial member 40. When the insertion groove 46 is aligned with the retaining groove 28, the retainer member 50 is elastically contracted and the inner rim of the retainer member 50 is buckled into the retaining groove 28. At this time, the inertial member 40 is connected with the main body 20 and located steadily without easy detachment.

Figure 7:
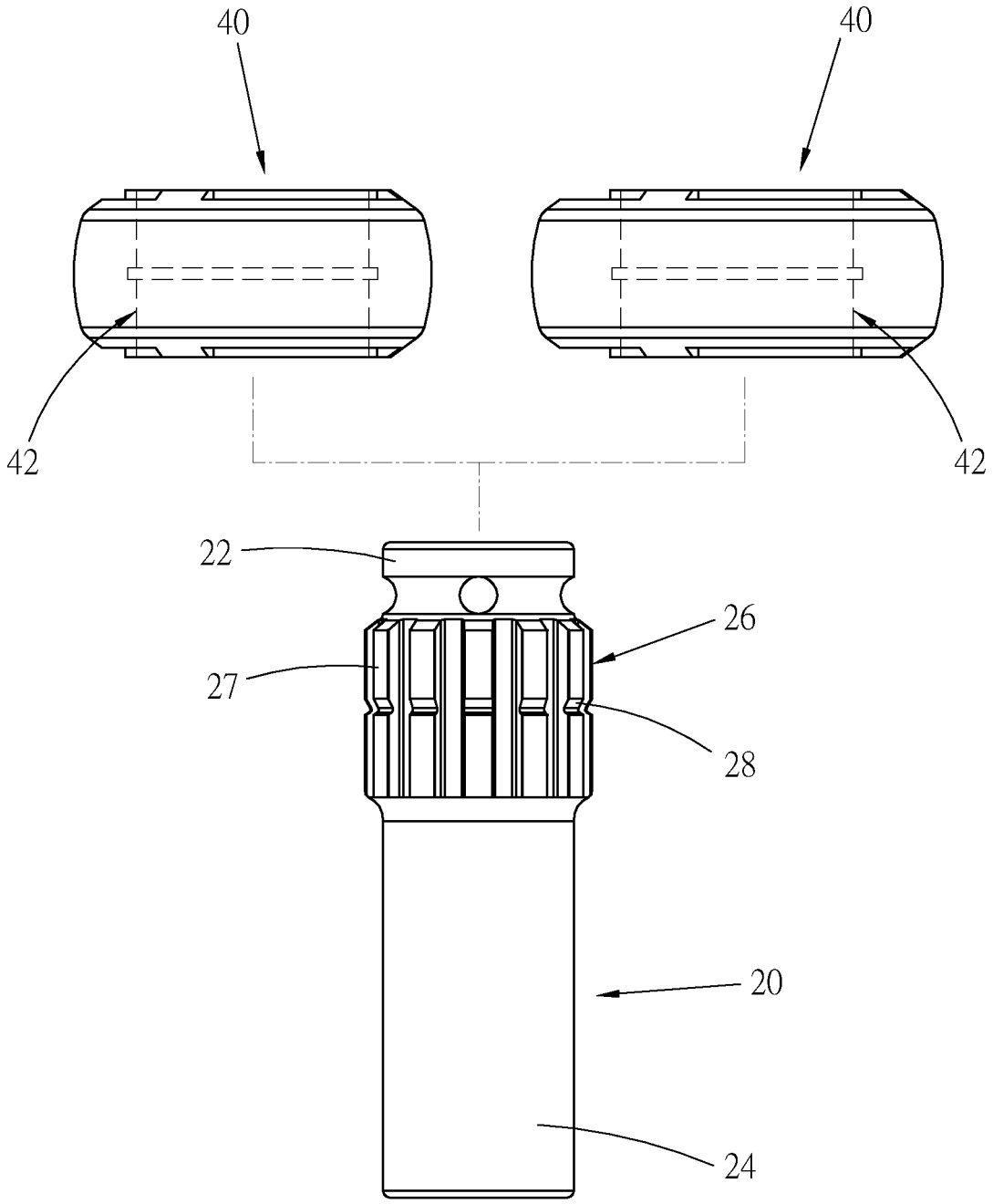
FIG. 7 shows that different inertial members with different mass can be selectively mounted on the main body of the rotational tightening device of the present invention.

Please refer to FIG. 7. The main body 20 of the present invention can be cooperated with many inertial members 40 with different mass. The engagement holes 42 of the inertial members 40 with different mass have the same size in adaptation to the engagement section 26 of the main body 20. Therefore, according to the size of the threaded member to be rotationally driven and the necessary rotational torque, an operator can select an inertial member with proper mass to install the inertial member on the main body, whereby the moment of inertia and the rotational torque of the rotational tightening device 10 can be changed.

Figure 8:
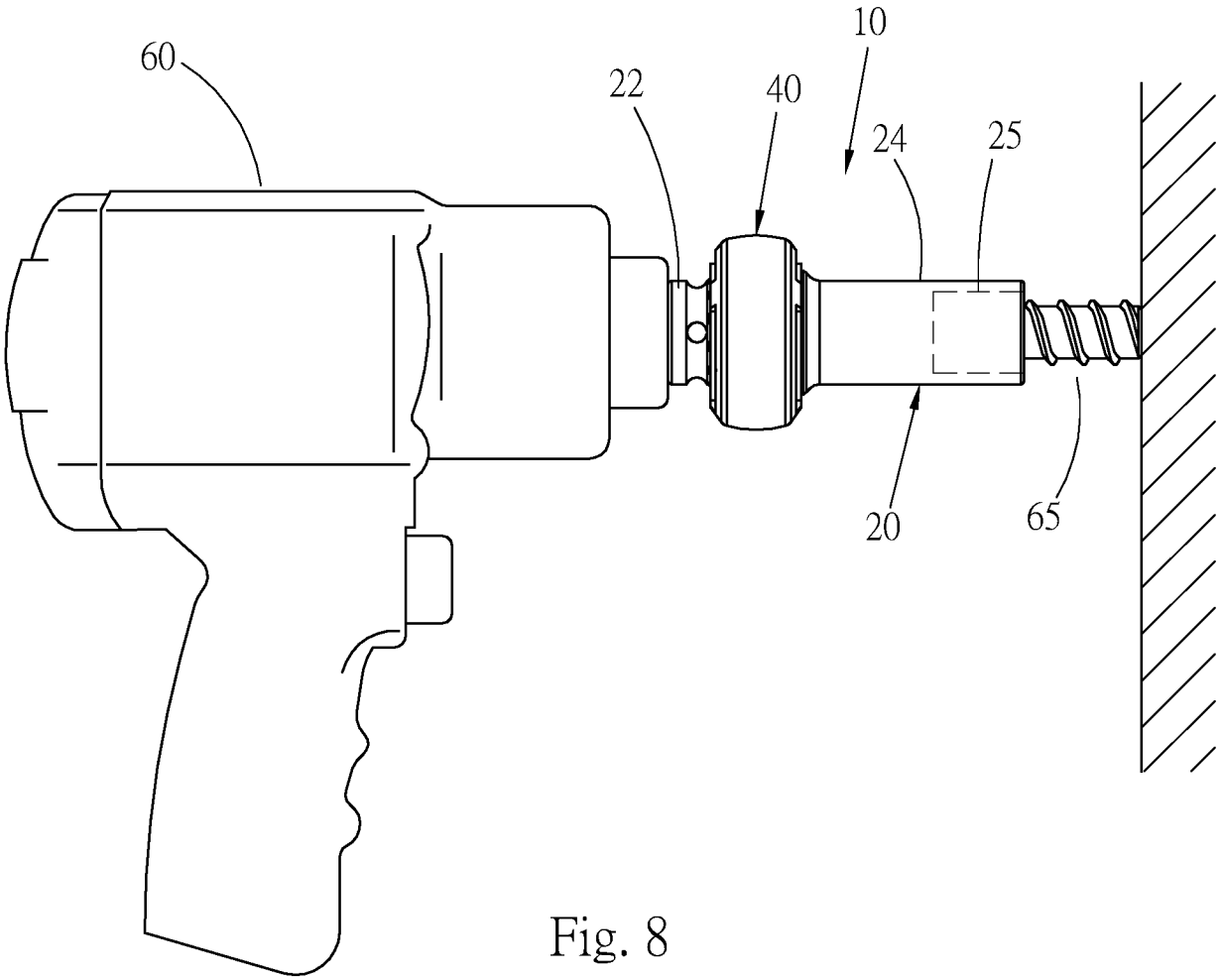
FIG. 8 is a side view showing that the rotational tightening device of the present invention is connected with a power tool to rotationally drive a threaded member.

Please now refer to FIG. 8. When tightening a threaded member, the linking end 22 of the tightening device 10 is connected with a transmission shaft (not shown) of a power tool 60 (such as a pneumatic wrench). The socket 25 of the drive end 24 is fitted with a threaded member 65. When the power tool 60 drives the tightening device 10 to clockwise rotate, the threaded member 65 is tightened. When the power tool 60 drives the tightening device 10 to counterclockwise rotate, the threaded member 65 is untightened. When the inertial member 40 rotates, the moment of inertia of the inertial member 40 creates a tangential impact force centered at the central axis C of the tightening device so as to provide greater instantaneous torque for enhancing the tightening or untightening effect for the threaded member.

Figure 9:
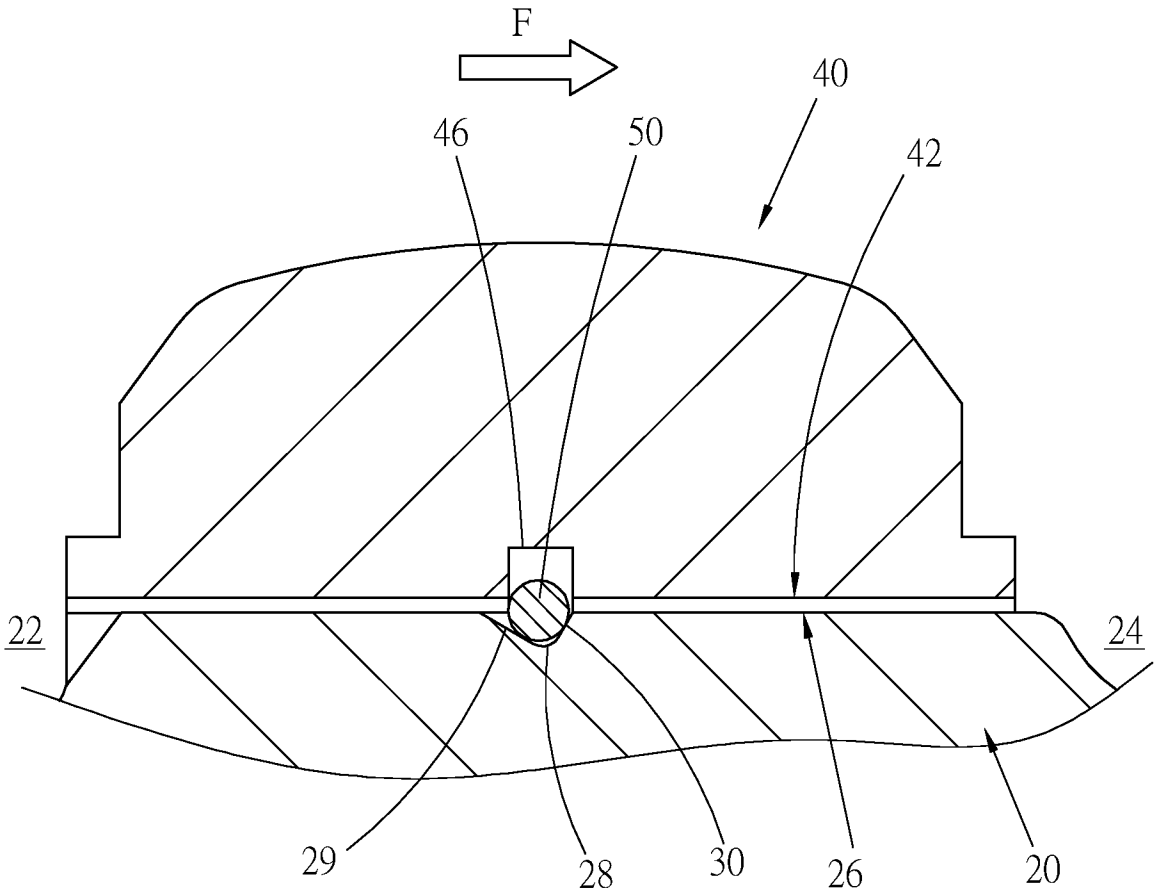
FIG. 9 shows the operation relationship of the rotational tightening device of the present invention in rotation.

Please refer to FIG. 9. When the tightening device 10 is clockwise rotated, according to the right-hand rule, the inertial member 40 creates a momentum F making the inertial member 40 move toward the drive end 24 and the article to be connected. The faster the rotational speed of the inertial member 40 is and the larger the mass of the inertial member 40 is, the greater the momentum F is. In the design of the present invention, the slope of the front groove wall 30 of the retaining groove 28 is larger, that is, the inclination angle of the front groove wall 30 is larger so that the front groove wall 30 has higher resistance against the momentum F of the inertial member 40. In this case, the inertial member 40 is prevented from detaching from the main body 20 in a direction to the drive end 24 so that the inertial member 40 will not hit the article to be connected.

In order to make the front groove wall 30 of the retaining groove 28 have higher resistance, the front groove wall 30 has larger inclination angle. Alternatively, this can be achieved by means of increasing the frictional force of the front groove wall 30. Under such circumstance, it is uneasy for the retainer member 50 to slip out of the retaining groove 28 from the front groove wall 30 so that the inertial member 40 can be retained on the main body 20.

In addition, the tooth flanks 271, 441 of the first and second engagement teeth 27, 44 are designed to be in point-contact with each other. In this case, the first and second engagement teeth 27, 44 are prevented from clogging with each other.

The inertial member 40 of the rotational tightening device 10 of the present invention is replaceable in accordance with the size of the tightening member (threaded member) to be rotationally driven and the needed tightening extent. Accordingly, the moment of inertia and the rotational torque of the rotational tightening device 10 can be changed. This solves the problem of the conventional rotational tightening device that the moment of inertia is constant and unchangeable.

It should be noted that the retaining groove 28 and the insertion groove 46 can be exchanged. That is, the retaining groove 28 is disposed on the hole wall of the engagement hole 42 of the inertial member 40 to intersect the second engagement teeth 44, while the insertion groove 46 is disposed on the engagement section 26 of the main body 20 to intersect the first engagement teeth 27. The retainer member 50 is buckled in the retaining groove 28 and the insertion groove 46. This arrangement can achieve the same effect.

The above embodiments are only used to illustrate the present invention, not intended to limit the scope thereof. Many modifications of the above embodiments can be made without departing from the spirit of the present invention.

What is claimed is:

1. An inertial rotational tightening device comprising:

a main body having an axis, the main body being rotatable around the axis as a center, the main body further having a linking end and a drive end respectively disposed at two ends of the main body;

an annular engagement section disposed on a circumference of the main body, an annular retaining groove being formed on the engagement section, the retaining groove having a configuration with a wider opening and a narrower interior;

an inertial member having an engagement hole axially formed through the inertial member, an annular insertion groove being formed on a hole wall of the engagement hole, the engagement hole of the inertial member being detachably engaged with the engagement section of the main body; and an elastic retainer member having the form of a ring, the rims of the elastic retainer member being inlaid and buckled in the retaining groove and the insertion groove.

2. The inertial rotational tightening device as claimed in claim 1, wherein the retaining groove is formed with two inclined groove walls, that is, a rear groove wall proximal to the linking end and a front groove wall proximal to the drive end, the front groove wall having a resistance greater than a resistance of the rear groove wall.

3. The inertial rotational tightening device as claimed in claim 2, wherein the front groove wall is more inclined than the rear groove wall.

4. The inertial rotational tightening device as claimed in claim 2, wherein the front groove wall has a frictional force greater than a frictional force of the rear groove wall.

5. The inertial rotational tightening device as claimed in claim 1, wherein the engagement section has multiple first engagement teeth annularly arranged on the circumference of the main body at equal intervals, the engagement hole having multiple second engagement teeth arranged on the circumferential wall of the engagement hole at equal intervals, the first engagement teeth of the engagement section being engaged with the second engagement teeth of the engagement hole.

6. The inertial rotational tightening device as claimed in claim 5, wherein the tooth flanks of the adjacent first and second engagement teeth are in point-contact with each other.

7. The inertial rotational tightening device as claimed in claim 6, wherein the first engagement teeth and the second engagement teeth are quadrangular teeth and the slope of the tooth flank of the first engagement teeth is different from the slope of the tooth flank of the second engagement teeth.

8. An inertial rotational tightening device comprising:

a main body having an axis, the main body being rotatable around the axis as a center, the main body further having a linking end and a drive end respectively disposed at two ends of the main body;

an annular engagement section disposed on a circumference of the main body, an annular insertion groove being formed on the engagement section;

an inertial member having an engagement hole axially formed through the inertial member, an annular retaining groove being formed on a hole wall of the engagement hole, the retaining groove having a configuration with a wider opening and a narrower interior, the engagement hole of the inertial member being detachably engaged with the engagement section of the main body; and an elastic retainer member having the form of a ring, the rims of the elastic retainer member being inlaid and buckled in the retaining groove and the insertion groove.

9. The inertial rotational tightening device as claimed in claim 8, wherein the retaining groove is formed with two inclined groove walls, that is, a rear groove wall proximal to the linking end and a front groove wall proximal to the drive end, the front groove wall having a resistance greater than a resistance of the rear groove wall.

10. The inertial rotational tightening device as claimed in claim 9, wherein the front groove wall is more inclined than the rear groove wall.

11. The inertial rotational tightening device as claimed in claim 9, wherein the front groove wall has a frictional force greater than a frictional force of the rear groove wall.

12. The inertial rotational tightening device as claimed in claim 8, wherein the engagement section has multiple first engagement teeth annularly arranged on the circumference of the main body at equal intervals, the engagement hole having multiple second engagement teeth arranged on the circumferential wall of the engagement hole at equal intervals, the first engagement teeth of the engagement section being engaged with the second engagement teeth of the engagement hole.

13. The inertial rotational tightening device as claimed in claim 12, wherein the tooth flanks of the adjacent first and second engagement teeth are in point-contact with each other.

14. The inertial rotational tightening device as claimed in claim 13, wherein the first engagement teeth and the second engagement teeth are quadrangular teeth and the slope of the tooth flank of the first engagement teeth is different from the slope of the tooth flank of the second engagement teeth.

* * * * *